US007338288B1

(12) United States Patent
Kung et al.

(10) Patent No.: US 7,338,288 B1
(45) Date of Patent: Mar. 4, 2008

(54) BATTERY CONNECTING STRUCTURE

(75) Inventors: Shih-Che Kung, Sanchong (TW); Wei-Hung Chung, Sanchong (TW)

(73) Assignee: Vega Force International Corp., Taipei County (TW)

( * ) Notice: Subject to any disclaimer, the term of this patent is extended or adjusted under 35 U.S.C. 154(b) by 0 days.

(21) Appl. No.: 11/647,184

(22) Filed: Dec. 29, 2006

(51) Int. Cl.
*H01R 39/00* (2006.01)

(52) U.S. Cl. ..... 439/31

(58) Field of Classification Search ..... 439/31, 439/169, 30, 29, 700
See application file for complete search history.

(56) References Cited

U.S. PATENT DOCUMENTS 3,190,978 A * 6/1965 Huget ..... 200/51 R
6,280,258 B1 * 8/2001 Frohlund ..... 439/700

* cited by examiner

*Primary Examiner*—Phuong Dinh
(74) *Attorney, Agent, or Firm*—Troxell Law Office, PLLC

(57) ABSTRACT

The present invention provides an improved battery connecting structure, structured from a frontal disposed portion, an abutting joint portion and a joining portion. A movement device is configured interior of the frontal disposed portion, and conducting wires extend therefrom and connect to connecting holes corresponding to conductive contact tags of the joining portion, and turning shafts are located on the frontal disposed portion corresponding to the conductive contact tags of the connecting holes. Conducting wires further extend from connecting holes of the joining portion and connect to a power supply member. Accordingly, when a rotating movement is performed on the frontal disposed portion and the joining portion by means of the turning shafts, then the conductive contact tags of the abutting joint portion serve to realize an electric circuit, thererby achieving objectives of preventing exposing and damaging the conducting wires, and providing convenience of use and portability.

3 Claims, 6 Drawing Sheets

BATTERY CONNECTING STRUCTURE

BACKGROUND OF THE INVENTION (a) Field of the Invention

The art of the present invention provides an improved battery connecting structure, and more particularly to turning shafts that enable movement of a frontal disposed portion and a joining portion using an abutting joint portion, and conductive contact tags of the joining portion are electrically connected to connecting holes of the frontal disposed portion and the joining portion, thereby enabling a power supply member to conduct electric power to a movement device.

(b) Description of the Prior Art

Accordingly, referring to FIG. 1 and FIG. 2, which show a conventional electrically operated machine gun structure A, primarily structured to comprise a frontal disposed portion A1 and a rear portion A2, wherein a movement member A3 is configured interior of the frontal disposed portion A1. The movement member A3 is connected to a battery member A5 of the rear portion A2 using conducting wires A4, thereby achieving objective of enabling electric power to be conducted to the electrically operated machine gun structure A. However, because the frontal disposed portion A1 is fixedly joined to the rear portion A2, thus, it forbids a collapsing movement of the rear portion A2, and creates serious misgivings over fastening space and inconvenience of portability.

Hence, the inventor of the present invention proposes to resolve and surmount existent technical difficulties to eliminate the aforementioned shortcomings of prior art.

SUMMARY OF THE INVENTION

The art of the present invention provides an improved battery connecting structure, and more particularly to turning shafts that enable movement of a frontal disposed portion and a joining portion using an abutting joint portion, and conductive contact tags of the joining portion are electrically connected to connecting holes of the frontal disposed portion and the joining portion, thereby achieving objectives of enabling electric power to be conducted to a movement device, preventing exposing and damaging conducting wires, providing convenience of use and enhancing aesthetic appeal.

To enable a further understanding of said objectives and the technological methods of the invention herein, brief description of the drawings is provided below followed by detailed description of the preferred embodiments.

DETAILED DESCRIPTION OF THE PREFERRED EMBODIMENTS

Figure 1:
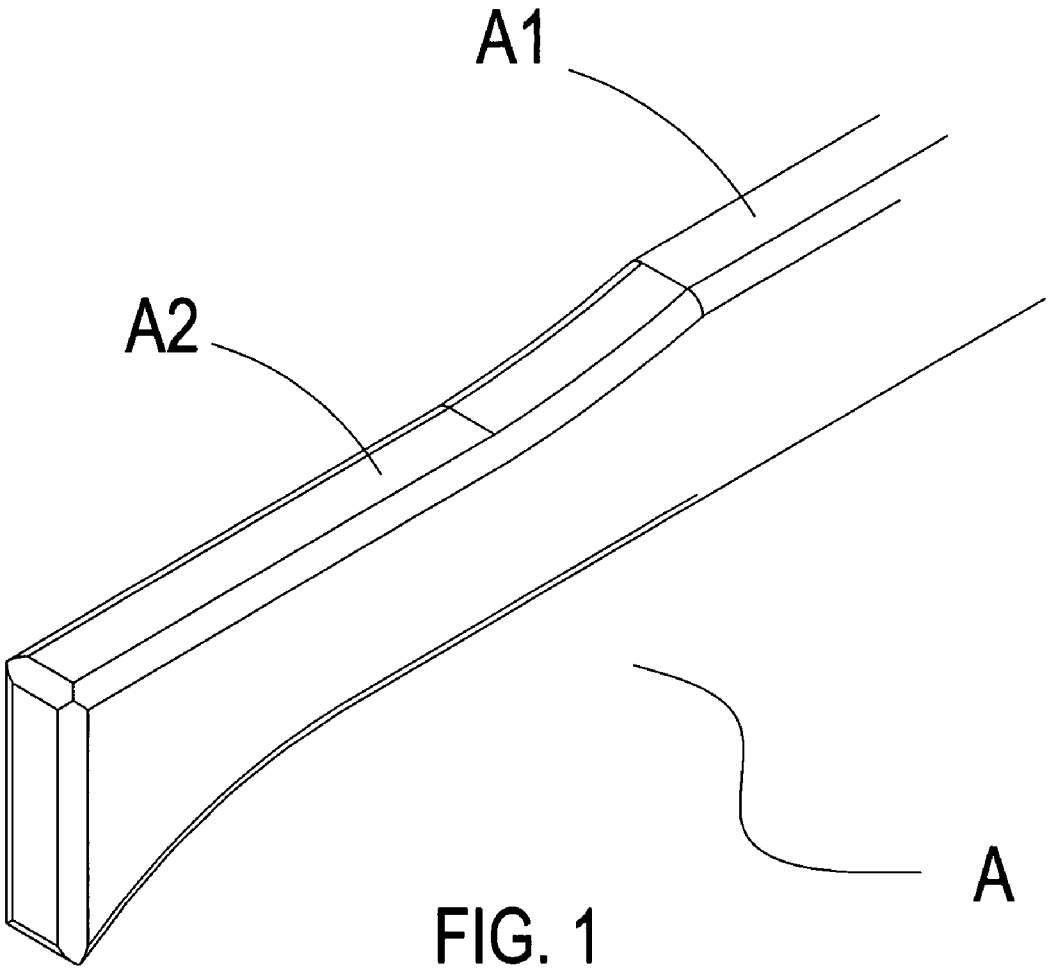
FIG. 1 Prior Art
FIG. 1 shows an elevational cutaway view of a prior art battery connecting structure.
Figure 2:
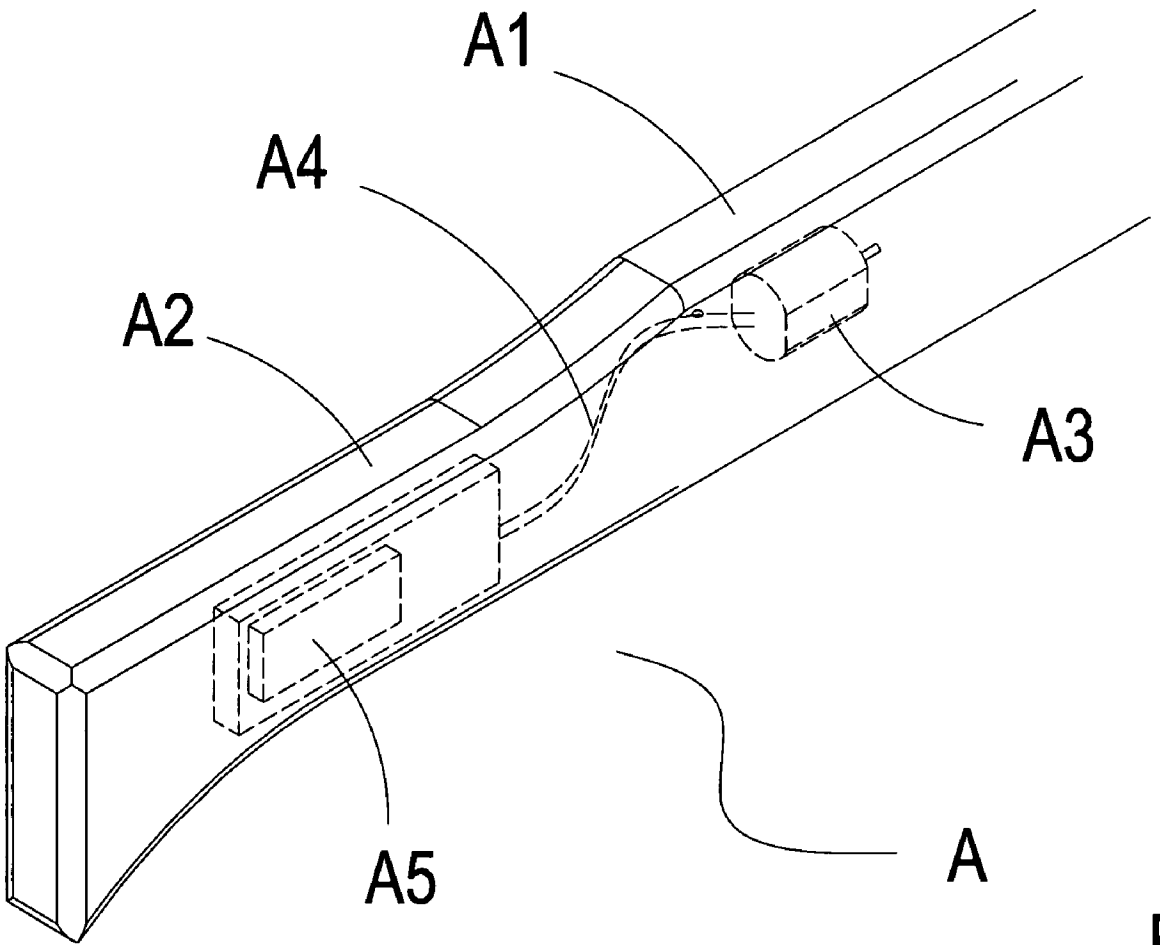
FIG. 2 Prior Art
FIG. 2 shows a cutaway elevational view of a prior art battery connecting structure.
Figure 3:
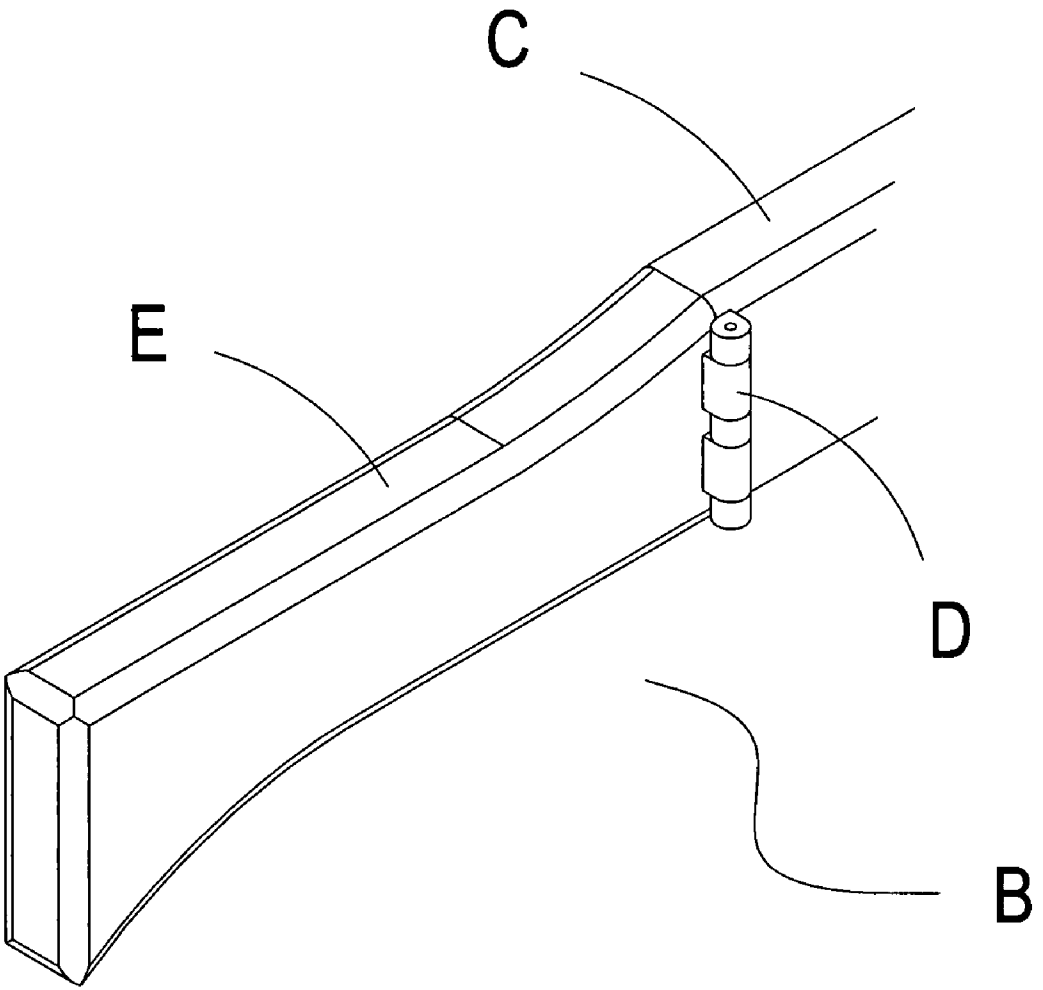
FIG. 3 shows an elevational according to the present invention.
Figure 4:
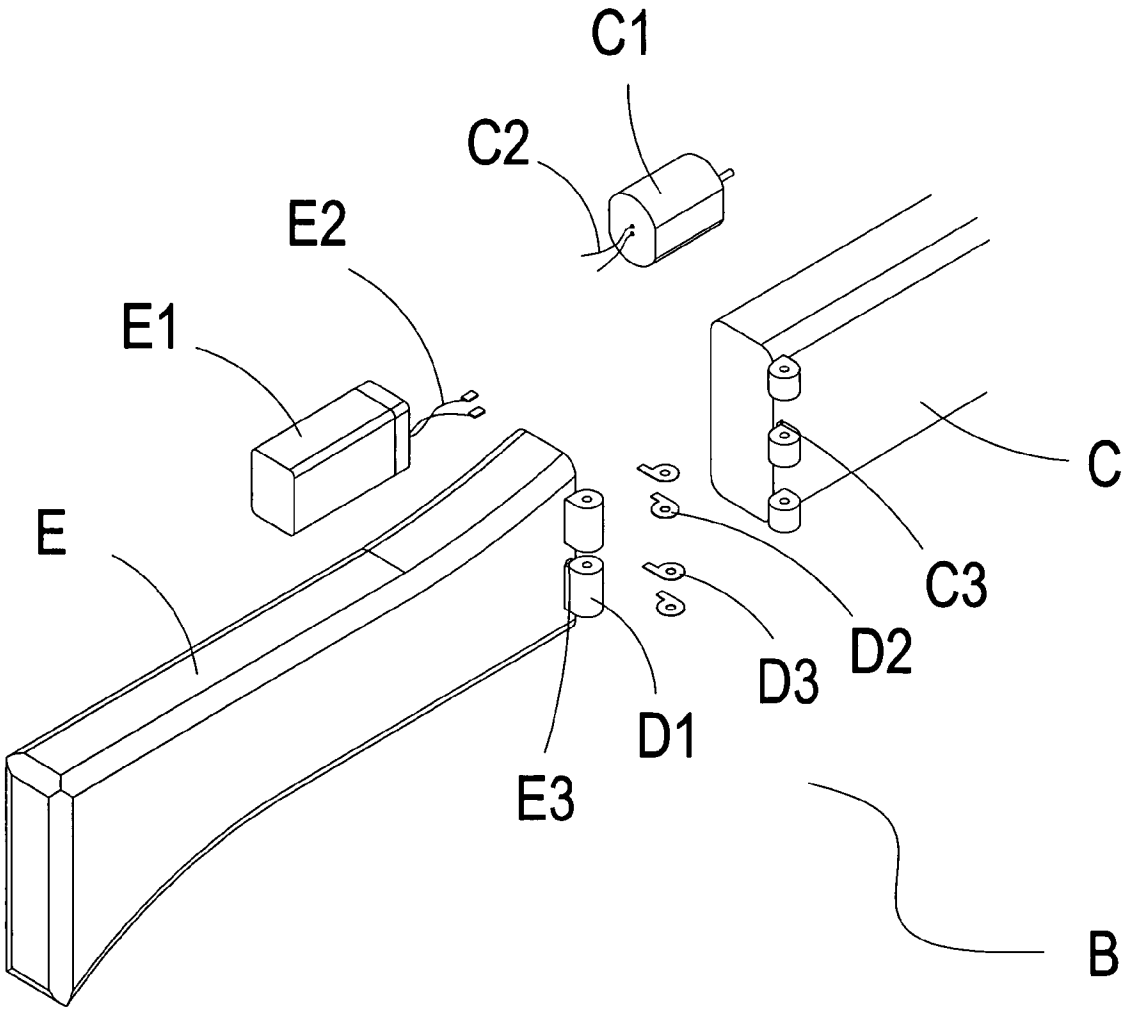
FIG. 4 shows an exploded elevational according to the present invention.

Referring to FIG. 3 and FIG. 4, which show an improved battery connecting structure of the present invention, wherein a connecting structure B is structured to comprise a frontal disposed portion C, an abutting joint portion D and a joining portion E.

Figure 5:
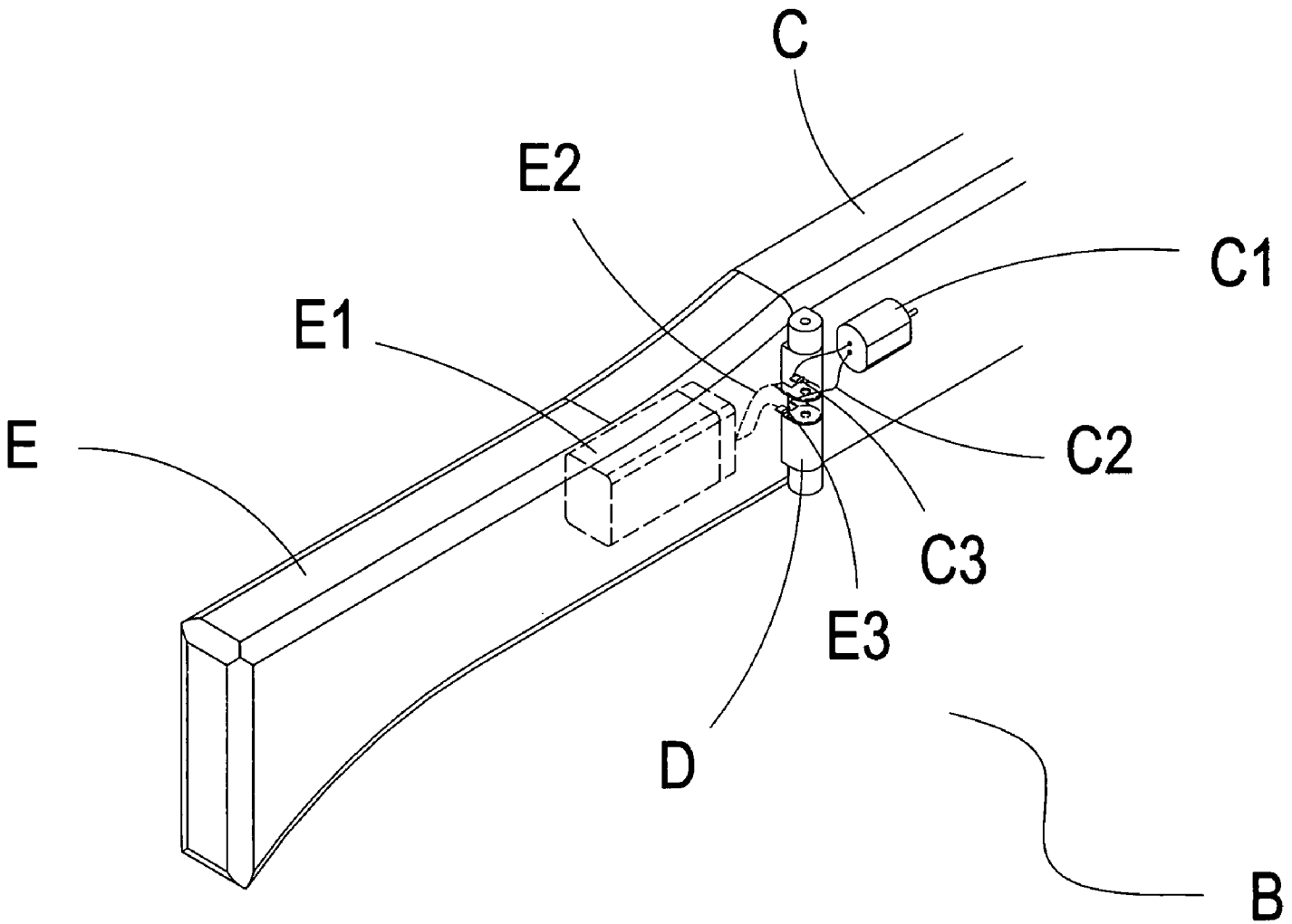
FIG. 5 shows a first view of an embodiment according to the present invention.
Figure 6:
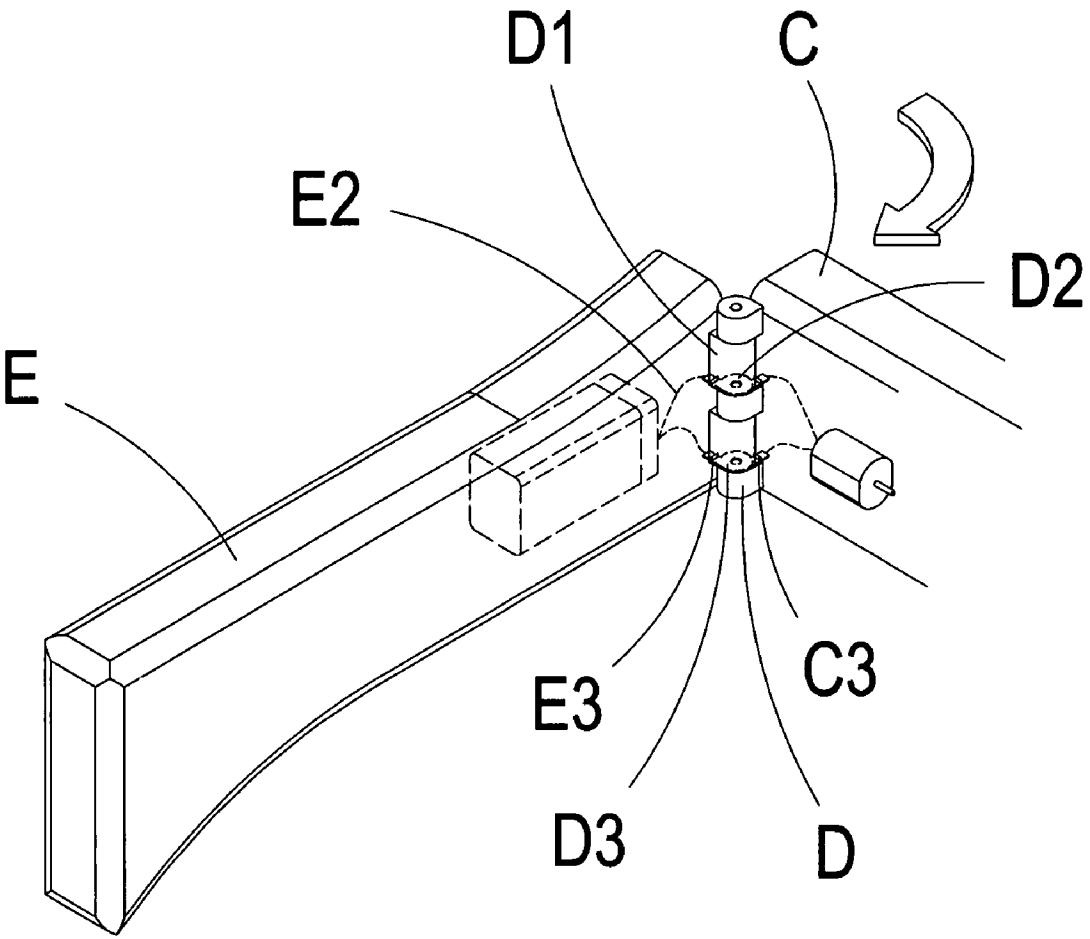
FIG. 6 shows a second view of the embodiment according to the present invention.

A movement device C1 is disposed interior of the frontal disposed portion C, and conducting wires C2 extend from the movement device C1 to enable the supply of electric power thereto, and ends of the conducting wires C2 extend and connect to connecting holes C3. The connecting holes C3 of the frontal disposed portion C correspond to conductive contact tags D2 of the abutting joint portion D. The conductive contact tags D2 are located on the abutting joint portion D, and turning shafts D1 are further located on the abutting joint portion D. Moreover, conductive contact tags D3 located on the abutting joint portion D are further electrically connected to connecting holes E3 of the joining portion E. Furthermore, conducting wires E2 extend from the connecting holes E3 and connect to a power supply member E1, thereby achieving objectives of enabling the power supply member E1 to conduct electric power to the movement device C1, preventing exposing and damaging the conducting wires C2, E2, providing convenience of use and enhancing aesthetic appeal. Referring to FIG. 5 and FIG. 6, which show an embodiment of the improved battery connecting structure of the present invention, wherein the abutting joint portion D is configured between the frontal disposed portion C of the connecting structure B and the joining portion E to enable separating and closing of the frontal disposed portion C and the joining portion E. The frontal disposed portion C comprises the movement device C1 and the conducting wires C2, and ends of the conducting wires C2 are electrically connected to the movement device C1, whereas the other ends are electrically connected to the connecting holes C3. The joining portion E comprises the power supply member E1 and the conducting wires E2, and ends of the conducting wires E2 are connected to the power supply member E1, whereas the other ends are electrically connected to the connecting holes E3.

The abutting joint portion D is configured with the turning shafts D1 to enable separating and closing of the frontal disposed portion C and the joining portion E, and the conductive contact tags D2, D3 are located on the abutting joint portion D. Moreover, the conductive contact tags D2, D3 are inserted into the connecting holes C3 of the frontal disposed portion C and the connecting holes E3 of the joining portion E respectively to enable forming a conducting circuit, thus, the power supply member E1 is able to supply electric power to the movement device C1. Furthermore, the turning shafts D1 of the abutting joint portion D are used to enable a separating movement of the joining portion E from the frontal disposed portion C, and when the joining portion E is separating from the frontal disposed portion, the conducting wires C2, E2 are retained within the frontal disposed portion C and the joining portion E respectively, thereby achieving the objectives of preventing exposing and damaging the conducting wires C2, E2 when the frontal disposed portion C and the joining portion E are separating and coming together, providing convenience of use and enhancing aesthetic appeal.

The connecting structure B has further application in electrically operated machine gun structures, distribution box structures, electrically operated gate structures and related structures that conduct power to the movement device C1 through the conducting wires C2, E2. Moreover, the power supply member E1 may be a nickel hydrogen battery, a nickel cadmium cell, a lithium battery and related members able to supply electric power.

In order to better explicitly disclose advancement and practicability of the present invention, a comparison with prior art is described hereinafter:

SHORTCOMINGS OF PRIOR ART

1. A frontal disposed portion is fixedly joined to a rear portion.
2. Unable to collapse the rear portion.
3. Creates misgivings over fastening space and inconvenience of portability.

Advantages of the present invention

1. The abutting joint portion D is configured with the conductive contact tags D2, D3 to realize an electric circuit.
2. Able to prevent the problem of exposing and damaging the conducting wires C2, E2.
3. Convenient to carry and use, and enhances aesthetic appeal of the entire structure.
4. The joining portion E can be collapsed.
5. Provided with advancement and practicability.
6. Enhances industrial competitiveness.

In conclusion, the present invention in overcoming structural shortcomings of prior art has assuredly achieved effectiveness of anticipated advancement, and, moreover, is easily understood by persons unfamiliar with related art. Furthermore, contents of the present invention have not been publicly disclosed prior to this application, and practicability and advancement of the present invention clearly comply with essential elements as required for a new patent application. Accordingly, a new patent application is proposed herein.

It is of course to be understood that the embodiments described herein are merely illustrative of the principles of the invention and that a wide variety of modifications thereto may be effected by persons skilled in the art without departing from the spirit and scope of the invention as set forth in the following claims.

What is claimed is:

1. A battery connecting structure, comprising:

a frontal disposed portion, interior of which is disposed a motor, conducting wires able to provide an electrical connection extend from a movement device, and ends of the conducting wires extend and connect to connecting holes;

an abutting joint portion configures with turning shafts, conductive contact tags able to provide an electrical connection are located on the abutting joint portion;

a joining portion, interior of which is configured a power supply member, conducting wires able to provide an electrical connection extend from the power supply member, and ends of the conducting wires extend and connect to connecting holes;

whereby when the frontal disposed portion and the joining portion are joined together and a rotating movement is performed thereon by the turning shafts of the abutting joint portion, then the conductive contact tags of the abutting joint portion simultaneously join to conductive contact points of the frontal disposed portion and the joining portion, thereby enabling the power supply member to conduct electric power to the motor.

2. The battery connecting structure according to claim 1, wherein the power supply member is selected from the group consisting of a nickel hydrogen battery, a nickel cadmium cell, and a lithium battery.

3. The battery connecting structure according to claim 1, wherein the connecting structure is configured for an application selected from the group consisting of electrically operated machine gun structures, distribution box structures, and electrically operated gate structures.

* * * * *